US011767745B2

(12) United States Patent
Willberg et al.

(10) Patent No.: US 11,767,745 B2
(45) Date of Patent: Sep. 26, 2023

(54) USE OF ENERGETIC EVENTS AND FLUIDS TO FRACTURE NEAR WELLBORE REGIONS

(71) Applicant: SCHLUMBERGER TECHNOLOGY CORPORATION, Sugar Land, TX (US)

(72) Inventors: Dean Willberg, Tucson, AZ (US); Jeffrey Burghardt, Tooele, UT (US); Maxim Chertov, Salt Lake City, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/279,644

(22) Filed: Sep. 29, 2016

(65) Prior Publication Data

US 2018/0087363 A1 Mar. 29, 2018

(51) Int. Cl.
*E21B 43/263* (2006.01)

(52) U.S. Cl.
CPC ..... *E21B 43/263* (2013.01)

(58) Field of Classification Search
CPC .... E21B 43/263; E21B 43/26; E21B 43/2605; E21B 43/2607; E21B 43/27; E21B 43/25; E21B 43/2635; E21B 43/267; E21B 43/247; E21B 43/248; E21B 43/243
USPC ..... 166/313
See application file for complete search history.

(56) References Cited

U.S. PATENT DOCUMENTS 3,075,463 A * 1/1963 Eilers ..... C06B 47/00 166/299
3,336,982 A * 8/1967 Woodward ..... E21B 43/263 166/299
3,396,790 A * 8/1968 Eaton ..... C09K 8/601 166/270
3,593,793 A * 7/1971 Kelseaux ..... E21B 43/263 102/325
3,744,579 A * 7/1973 Godfrey ..... E21B 7/14 166/63
4,039,030 A * 8/1977 Godfrey ..... E21B 43/263 166/177.5
4,049,056 A * 9/1977 Godfrey ..... E21B 43/263 166/299
4,103,743 A * 8/1978 Paul ..... E21B 36/02 166/299
4,360,062 A * 11/1982 Browning ..... E21B 43/263 166/299

(Continued)

OTHER PUBLICATIONS

Saffman-Taylor instability, retrieved Oct. 18, 2022 from https://en.wikipedia.org/wiki/Saffman%E2%80%93Taylor_instability (Year: 2022).*

(Continued)

*Primary Examiner* — Angela M DiTrani Leff
(74) *Attorney, Agent, or Firm* — Jeffrey D. Frantz

(57) ABSTRACT

A method includes placing a fluid in a treatment zone of a wellbore, the fluid in fluid communication with a near wellbore region of a subterranean formation. At least one energetic event generating material is placed in the wellbore, and positioned adjacent and up hole from the fluid. An energetic event is generated from the at least one energetic event generating material, and at least one fracture is formed in the near wellbore region from the at least one energetic event applying a pressure pulse onto the fluid. In some aspects, the fluid is a viscous pill.

18 Claims, 4 Drawing Sheets

(56) References Cited

U.S. PATENT DOCUMENTS

| | | | | |
|---|---|---|---|---|
| 4,716,967 | A * | 1/1988 | Mohaupt | E21B 43/263 166/299 |
| 4,751,966 | A * | 6/1988 | Jones | E21B 43/263 166/299 |
| 6,543,538 | B2 * | 4/2003 | Tolman | E21B 43/116 166/284 |
| 10,081,759 | B2 * | 9/2018 | Wernimont | E21B 43/243 |
| 2011/0272159 | A1 * | 11/2011 | Osiptsov | E21B 43/26 166/308.1 |
| 2013/0161007 | A1 * | 6/2013 | Wolfe | E21B 43/263 166/297 |

OTHER PUBLICATIONS

Bunger et al., "Application of Scaling Laws to Laboratory-Scale Hydraulic Fractures", ARMA/USRMS 05-818, Jun. 25-29, 2005, 9 pages.

Savitski et al., "Propagation of a penny-shaped fluid-driven fracture in an impermeable rock: asymptotic solutions", International Journal of Solids and Structures, vol. 39, Issue 26, Dec. 2002, pp. 6311-6337.

Chuprakov et al., "Injection-Sensitive Mechanics of Hydraulic Fracture Interaction with Discontinuities", Rock Mech Rock Eng., vol. 47, 2014, pp. 1625-1640.

Handren et al., "Overbalance Perforating and Stimulation Method for Wells", SPE 26515, Presented at the SPE Annual Technical Conference and Exhibition, Houston, Texas, Oct. 3-6, 1993, 10 pages.

Behrmann et al., "Underbalance or Extreme Overbalance", SPE Prod. & Facilities, vol. 14, No. 3, Aug. 1999, pp. 187-196.

Zoback et al., "Laboratory hydraulic fracturing experiments in intact and pre-fractured rock", Int. J. Rock. Mech. Min. Sci. & Geomech. Abstr., vol. 14, No. 2, 1977, pp. 49-58.

Couet et al., "Well-Productivity Improvement by Use of Rapid Overpressured Perforation Extension: Case History", SPE 30527, Journal of Petroleum Technology, Feb. 1996, pp. 154-159.

* cited by examiner

USE OF ENERGETIC EVENTS AND FLUIDS TO FRACTURE NEAR WELLBORE REGIONS

FIELD

The field to which the disclosure generally relates to is stimulation of subterranean formations, and in particular, fracturing a subterranean formation by initiating simple fractures in a near wellbore region.

BACKGROUND

This section provides background information to facilitate a better understanding of the various aspects of the disclosure. It should be understood that the statements in this section of this document are to be read in this light, and not as admissions of prior art.

Complexity or tortuousity of the near wellbore region in a hydraulic fracture is known as an issue in the construction of reliable hydraulic fractures, particularly in subterranean formations penetrated with horizontal or otherwise deviated wellbores. Complexity or tortuousity in the near wellbore region makes pumping of a hydraulic fracture fluid difficult by creating excess requisite pressure and limiting the placement of proppants. When the well is completed and then put into production, the near wellbore region becomes a stress dependent choke, and failure or closure of this critical region may lead to the failure of the entire fracture.

Unfortunately, in practice, the creation of the critically important near wellbore region is completely uncontrolled under current hydraulic fracturing field operational procedures. The conditions for fracture initiation are far from ideal for practically all hydraulic fractures pumped. Rather than initiating the fracturing at high rates, with a high viscosity fluid, most fractures are initiated with low viscosity brines at low rates. The pump rate is usually gradually increased from low to operational range as subsequent pumps are brought on-line. Furthermore, since fractures are "bullheaded" from the wellhead, the fluid used to create the fractures is that residual fluid remaining in the wellbore after the cleanout of the previous operational stage.

To the degree that the effect of the fluid viscosity and/or pump rate on the fracture geometry is considered, it is generally believed that low viscosity fluids are desirable since they will create more complex fractures and hence more surface area in contact with the reservoir. However, in fracturing operations, there is little or no recognition of the potential negative effects of fracture complexity in the near wellbore region.

Effort has been placed in attempts to optimize perforating and jetting practices for hydraulically fractured completions. The work has primarily focused on perforation/slot orientation, penetration beyond the hoop stress region, optimizing the aperture geometry and cross-section, and the hoop stress region immediately surrounding the wellbore. However, there has been no known effort to minimize the creation of near wellbore fracture complexity by optimizing the initial pumped fluids and pumping rate.

Thus, there exists an ongoing need for systems and methods to perform hydraulic fracturing operations which overcome near wellbore region fracture complexity while forming fractures extending deeper into the formation, such need met, at least in part, by the following disclosure.

SUMMARY

This section provides a general summary of the disclosure, and is not a necessarily a comprehensive disclosure of its full scope or all of its features.

In a first aspect of the disclosure, a method includes placing a fluid in a treatment zone of a wellbore, the fluid in fluid communication with a near wellbore region of a subterranean formation. At least one energetic event generating material is placed in the wellbore, and positioned adjacent and up hole from the fluid. An energetic event is generated from the at least one energetic event generating material, and at least one fracture is formed in the near wellbore region from the at least one energetic event applying a pressure pulse onto the fluid. In some cases, the fluid is a viscous pill. The at least one fracture formed in the near wellbore region may be a substantially planar fracture, which may also extend into a near field region of the subterranean formation. In some aspects, a packer is set in the wellbore downhole from the treatment zone prior to the placing a fluid, and a spacer fluid is placed in the wellbore up hole from the treatment zone.

The fluid placed at the treatment zone may be in fluid communication with the near wellbore region of a subterranean formation through at least one opening in a casing disposed in the wellbore. The opening may be a perforation formed in the casing, or an opening formed by activating a sliding sleeve integrated into the casing. When a sliding sleeve forms the opening, a coiled tubing bottom hole assembly may activate the sliding sleeve to open the sleeve.

In some embodiments, the fluid and the at least one energetic event generating material are placed in the wellbore via a coiled tubing string, and the energetic event is triggered by a mechanism integrated into the coiled tubing string. Alternatively, at least one of the fluid and the at least one energetic event generating material are pumped through the wellbore with surface equipment, and the at least one energetic event is triggered by surface equipment. One or more energetic events may be generated from the at least one energetic event generating material. In some cases the at least one energetic event generating material includes a fuel source and a material reactive with fuel source, and the material reactive with fuel source may oxidize the fuel source. In some aspects, the fluid and the at least one energetic event generating material are like or same materials.

In those cases where the at least one energetic event generating material includes a fuel source and a material reactive with fuel source, and the material reactive with fuel source oxidizes the fuel source, elastic compression of energetic event generating material and the engineered properties of the viscous pill and optional spacer fluid may also provide additional efficiency to energetic driven pumping. Furthermore, in some aspects, multiple sequential pressure pulses are released from the compressible energetic material. In some alternative embodiments, the at least one energetic event generating material stores the released energy in the form of elastic compression and the engineered properties of the viscous pill and optional spacer fluid may provide additional efficiency to energetic driven pumping, in the absence of a fuel source and a material reactive with fuel source; and in some cases, multiple sequential pressure pulses are released from the compressible energetic material.

Embodiments of methods according to the disclosure may further include placing a high viscosity fluid in the wellbore after the fracture(s) is formed in the near wellbore region, and the pressure of the high viscosity fluid is increased to further extend the fracture(s) into a far field area of the subterranean formation to form a substantially planar fracture. A substantially planar fracture may have some deviations from an ideal geometric plane of various types including but not limited to, for example, deviations of fracture surface orientation and secondary fracture branches. At the same time, all these deviations are reasonably small, so that the substantially planar fracture can be replaced by an ideal planar fracture of similar size in practical considerations, including, but not limited to efficiency of reservoir drainage, fracture conductivity and volume of materials spent to create the fracture. In some other embodiments, the methods further include placing a low viscosity fluid in the wellbore after the fracture(s) is formed in the near wellbore region, and increasing pressure of the low viscosity fluid to further extend the fracture(s) into a far field area of the subterranean formation to form a complex fracture network in the far field area.

In another aspect of the disclosure, a fluid is placed in a treatment zone of a wellbore, and is in fluid communication with a near wellbore region of a subterranean formation. At least one energetic event is generated from at least one energetic event generating material positioned proximate the treatment zone. At least one substantially planar fracture is formed in the near wellbore region from the at least one energetic event by applying a pressure pulse onto the fluid. The fluid in some cases may be a viscous pill. The substantially planar fracture(s) may extend into a near field region of the subterranean formation. In some cases, a high viscosity fluid is placed in the wellbore after the at least one fracture is formed in the near wellbore region, and pressure of the high viscosity fluid is increased to further extend the at least one fracture into a far field area of the subterranean formation to form a substantially planar fracture. In other cases, a low viscosity fluid is placed in the wellbore after the at least one fracture is formed in the near wellbore region, and pressure of the low viscosity fluid is increased to further extend the at least one fracture into a far field area of the subterranean formation to form a complex fracture network in the far field area.

Yet another aspect of the disclosure includes a system of a cased wellbore penetrating a subterranean formation having a near wellbore region, a near field region, which is farther away from the wellbore, and a far field region, which is yet farther away from the wellbore, than the near field region. The wellbore includes a viscous fluid pill disposed therein, and the viscous fluid pill is in fluid communication with a near wellbore region of a subterranean formation through at least one opening in the cased wellbore. A packer disposed in the wellbore downhole from the viscous fluid pill and at least one energetic event generating material is disposed up hole from the viscous pill. The system may be used to create at least one energetic event from the at least one energetic event generating material to form at least one substantially planar fracture in the near wellbore region by applying a pressure pulse onto the viscous pill.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various embodiments described herein, and.

DETAILED DESCRIPTION

Figure 1:
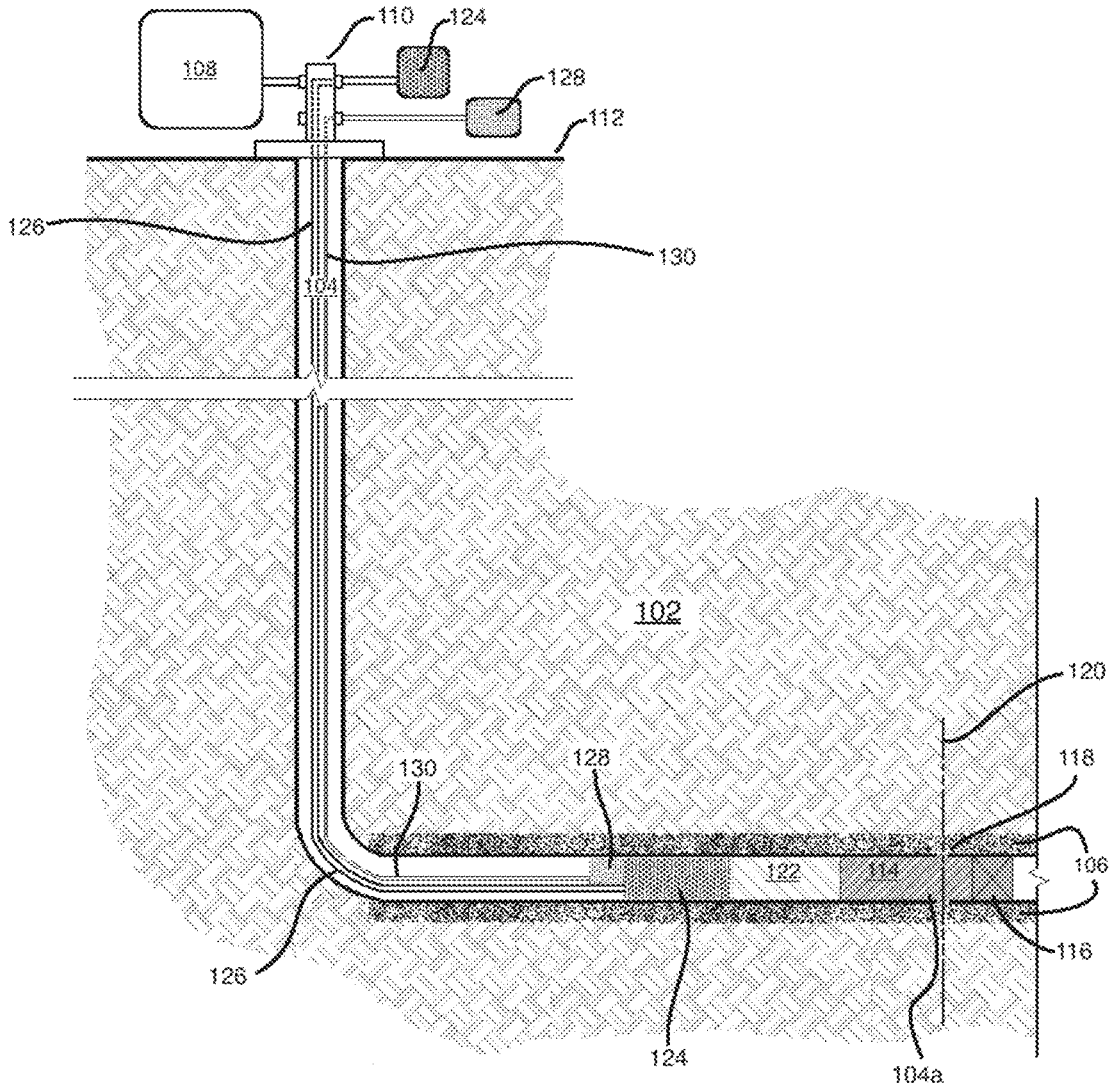
FIG. 1 illustrates an arrangement of equipment, materials and a wellbore penetrating a subterranean formation used in some embodiments of the disclosure, in a cross section view.

The following description of the variations is merely illustrative in nature and is in no way intended to limit the scope of the disclosure, its application, or uses. The description and examples are presented herein solely for the purpose of illustrating the various embodiments of the disclosure and should not be construed as a limitation to the scope and applicability of the disclosure. In the summary of the disclosure and this detailed description, each numerical value should be read once as modified by the term "about" (unless already expressly so modified), and then read again as not so modified unless otherwise indicated in context. Also, in the summary of the disclosure and this detailed description, it should be understood that a concentration, value or amount range listed or described as being useful, suitable, or the like, is intended that any and every concentration, value or amount within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific data points, it is to be understood that inventors appreciate and understand that any and all data points within the range are to be considered to have been specified, and that inventors had possession of the entire range and all points within the range.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Also, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Some method embodiments according to the disclosure relate to optimizing subterranean formation fracture morphology in the near wellbore region (hereinafter referred to as "NWB") by initiating the fracture with a volume of high viscosity fluid pumped at a high rate. The volume of fluid need not be large, as compared with conventional fracturing processes, but only of sufficient volume to create a fracture extending many feet into the formation from the wellbore. The motive force for pumping the fluid to create and enter into the fracture is produced, at least in part, from an energetic source disposed in the wellbore proximate the fracture initiation location, but not necessarily at the fracture initiation location.

The NWB is generally defined in this disclosure as the region of the fracture, or fracture network, extending from the perforation hole in the casing over a distance of many feet to tens of feet into the subterranean formation, and wellbore beyond the perforation tunnel, and the hoop-stress region which is the region having stress acting circumferentially around the wellbore, the stress generated as a result of removing the rock volume when the wellbore is created. Thus, the NWB includes the cement sheath, the perforating tunnel, the hoop-stress region, and a significant region of the hydraulically formed fracture created there beyond. Operationally, the NWB in horizontal wells is to be that section of the fractured subterranean formation that is connecting the wellbore to the petroleum product productive zones of the hydraulically fractured reservoir. It is also the region of the fracture where convergent flow can play a major role during production.

Fractures in the NWB are created by the very first few barrels of fluid pumped through the perforations during the first few seconds of the fracturing treatment, in some instances. The fracture created by only about 1 to 5 barrels of fracturing fluid extends up to many tens of feet away from the wellbore. Laboratory studies have also shown that significant fracture surface area can be created before the recognized breakdown pressure occurs (see Zoback, M., F., Rummel, R. Jung, and C. Raleigh. 1977. Laboratory hydraulic fracturing experiments in intact and pre-fractured rock. Int. J. Rock. Mech. Min. Sci. & Geomech. Abstr. 14:49-58). The morphology, or otherwise architecture, of this NWB may be governed by such factors as the rock texture in the region of the wellbore, the formation stress conditions (including but not limited to the hoop-stress and near field stresses), the fluid pumping rate, the treatment fluid viscosity, and formation rock/treatment fluid interactions. Rock fabric, such as planes of weakness, heterogenities, etc., may have a significant impact on the geometry of a hydraulic fracture, and some aspects of the disclosure relate to predicting, or otherwise modeling, the effects rock fabric may have in a given reservoir, rather than how a fracturing treatment is designed to control the effects. In some aspects, pumping rate and fluid viscosity may influence the interaction between a hydraulically created fracture propagating through a subterranean formation region and the rock fabric of the subterranean formation region. In some cases, increasing either or both the treatment fluid pumping rate and the viscosity of the fluid can minimize the effect of the rock fabric on the fracture geometry.

In comparison with extreme overbalanced perforating ("EOB") and rapid overpressured perforation extension ("ROPE") methods (see SPE-30527, 'Well-Productivity Improvement by Use of Rapid Overpressured Perforation Extension', Petitjean, L., Couet, B., Abel, J. C. et al. 1996), where the wellbore is charged with a high pressure fluid pumped from the surface at high rate/pressure to perforate and subsequently enter the perforations and fracture the formation thereafter, some embodiments according to the disclosure utilize localized high motive forces, or local energized events, to create the initial fracture with a viscous pill fluid. Also, some of the embodiments according to the disclosure utilize the viscous pill and optional spacer fluids with engineered properties to increase efficiency of high amplitude pressure pulse to pump viscous fracturing fluid into formation. In some cases, embodiments may be readily designed and scaled in energetic event magnitude, and may include a single or multiple energy pulses. Further, in some aspects, while some embodiments may include initial fracturing of the NWB through perforations created during the local energized event, while in other embodiments, initial fracturing of the NWB occurs through sliding sleeves, jetted perforations, pre-perforated casing, and the like. Also, in some aspects of the disclosure, wellbore storage effects may be well managed during the discharge of the energetic event(s).

In methods according to the disclosure, methods are useful to achieve optimal fracture morphology and minimal complexity in the NWB by initiating the fracture(s) with a fixed volume of high viscosity fluid pumped at a high rate using a energetic source generated locally in the wellbore proximate the targeted NWB. The volume of high viscosity fluid pumped under pressure from the energetic source is much less in comparison to the complete volume of fluid used in a fracture treatment, and a volume sufficient to create a fracture which extends through the NWB and feet or tens of feet beyond the NWB. Fracture complexity may be minimized in the NWB where high conductivity is sought, rather than a high fracture induced surface area, while large surface area in the far field area is achieved.

Referring to FIG. 1, which depicts in a cross section view an embodiment according to the disclosure, a subterranean formation of interest 102 is penetrated by wellbore 104, which may be a vertical wellbore, or deviated wellbore such as that shown. A portion of subterranean formation 102 adjacent wellbore 104 is a NWB 106, and in some instances, a cement sheath and casing may be disposed between NWB 106 and wellbore 104. In other cases, the wellbore 104 may be an open hole without a cement sheath and casing at the targeted treatment zone. Various formation treatment fluid preparation and delivery equipment 108 are in fluid communication with wellhead 110 and wellbore 104, and may be positioned upon surface 112 for land based operations, or upon/adjacent an offshore rig for offshore operations. Equipment 108 may include equipment known to those of skill in the art, such as blender(s) and dispersers to combine additives, base fluid and proppant into specific mixes of fracturing fluids, high-horsepower fracturing pumps, manifolds, storage tanks, facilities for monitoring, data recording, satellite communication and remote pumper controls to monitor and control the treatment and also record the data related to each phase of the fracture, coiled tubing treatment equipment, wireline equipment, and the like.

A viscous fluid pill 114 is placed in treatment zone **104*a* of wellbore 104, up hole (or otherwise nearer the surface) from a packer 116 or any suitable isolation device, set in the wellbore zone 104*a* prior to the treatment. Openings 118 (two shown), already existing in casing and/or cement sheath by perforation, sliding sleeve, and the like, and combinations thereof, or pilot holes in the case of open hole, are provided to enable fluid communication with NWB 106, formation 102 and viscous fluid pill 114, as well as facilitating fracturing along plane 120. In those embodiments where sliding sleeves are utilized for the openings 118, the operation may be, in some cases, a single stage method using coiled tubing conveyance and activation of the sliding sleeve after the viscous pill 114 and other fluids are placed in wellbore 104**.

After viscous fluid pill 114 is placed, an optional spacer fluid 122 may be placed in wellbore 104 adjacent fluid pill 114. A fuel source 124 for enabling an energetic event is disposed in wellbore 104 up hole and proximate viscous fluid pill 114 and optional spacer fluid 122. The role of an optional spacer fluid is to convert most efficiently the energetic event into the mechanical movement of the viscous pill pumped into the rock. In some cases fuel source 124 is delivered to a target location in wellbore 104 by pumping down hole from the surface through the wellbore, while in other embodiments, a first control line or tubing 126 connected with a surface supply of fuel source 124 is utilized. In order to generate an energetic event a material 128 reactive with fuel source 124, such as an oxidizer, is delivered from a surface supply through a second control line or tubing 130. While a spacer fluid is shown disposed between fuel source 124 and viscous fluid pill 114, in some embodiments the fuel source 124 is immediately adjacent viscous fluid pill 114, while in others, fuel source 124 is separated from viscous fluid pill 114 by a sliding piston, such as a dart or cement plug. Viscous fluid pill 114, packer 116, spacer fluid 122, fuel source 124, a dart, a cement plug, may be placed in wellbore 104 by any suitable technique, including, but not limited to any one or more of pumping down hole, coiled tubing, wireline, slickline, tubing conveyance, and the like.

In some aspects, the additional tamping fluid pills or wellbore devices may be placed in the wellbore above the energetic material. The additional fluid pills or fluid packages (multiple layers of fluids with predesigned rheologies, densities and thicknesses) may be placed up hole from viscous fluid pill 114 and fuel source 124, such as a weighted fluid to tamp and increase the efficiency of the energetic event, and/or protect the wellhead or other features of and equipment in the wellbore. In some other aspects, wellbore tools may be placed up hole from the fuel source 124, and may be useful as ignition sources, to tamp the energetic event, increase efficiency of the event, facilitate downhole measurements, and/or protect the wellhead or other features of and equipment in the wellbore.

Figure 2A:
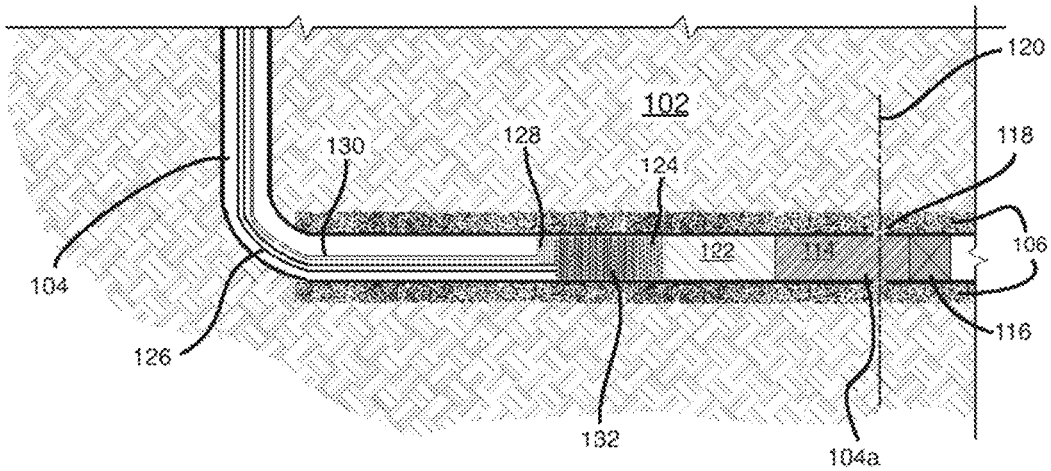
FIGS. 2*a*-2*c* depict some stages used forming fracture(s) in a near wellbore area, in accordance with the disclosure, in a cross section view.

Now with reference to FIG. 2*a*, which illustrates a portion of wellbore 104 where an operation in accordance with the disclosure is to be conducted, after placement of packer 116, viscous fluid pill 114, spacer fluid 122 and fuel source 124, material 128 reactive with fuel source 124 is delivered through the second control line or tubing 130. The reactive material 128 is mixed with fuel source 124 to form mixture 132. Upon mixing, the mixture 132 may be ignited by external ignition, or auto-ignite due to mixing. As mixture 132 ignites, an energetic event is onset which discharges energy 134 in the form of a pressure pulse, which is ultimately transmitted to viscous fluid pill 114, in the direction shown by the arrows extending through energy 134, spacer 122 and viscous fluid pill 114 in FIG. 2*b*. While shown is a mixture of a fuel source and a reactive material for creating the energetic event by ignition, the energy event may be created by any suitable technique, including a propellant stick ignited by wireline or pressure pulses, an ignitable liquid propellant or explosive liquid mixture, or a liquid, gas or multi-phases fuel oxidizer mixture. Also, rapid release of gas could be used, for example, release of a gas pulse through a rupture disk or a pulsed valve. The energetic event may produce a single pressure pulse in some instances, while in others, a series of pressure pulses is created.

Figure 2B:
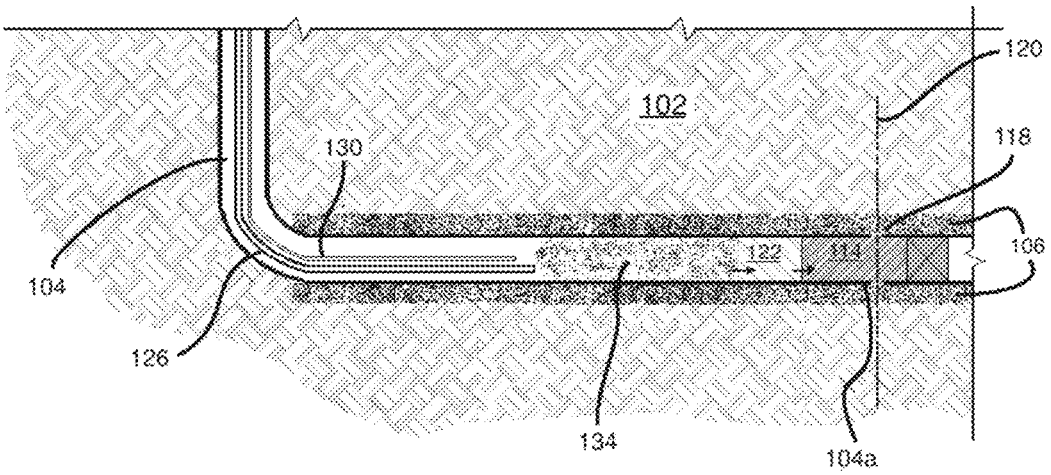
Figure 2C:
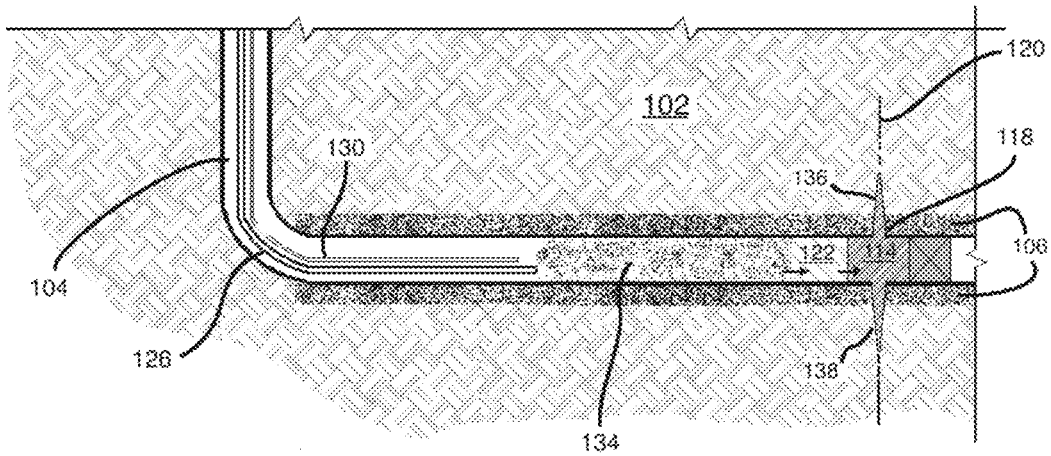

In embodiments of the disclosure, the energetic source provides a motive force for pumping the viscous pill 114 through openings 118, at suitable pressure and flow rate to initiate a fracture in NWB 106 along plane 120, which further extends into formation 102. FIG. 2*c* depicts single plane fractures 136 and 138 formed along plane 120 through NWB 106 and into formation 102 as a result of the pressure pulse formed from the energetic event described above, which forces viscous pill 114 through openings 118. As depicted, the energetic event, which creates a pressure pulse upon viscous pill 114 as a result of expansion of gas, combustion products, or explosive products, does not work directly on the formation, but rather, indirectly through the medium of the viscous pill as the fracture(s) are created. It is, however, within the scope of the disclosure, that at the end of the energetic event, the gas, combustion products, or explosive products, may have direct contact with the fracture. As indicated in FIG. 2C, fractures 136 and 138 formed through NWB 106 along plane 120 are simple and non-complex fractures, which overcome the potential for fracture or wellbore instability that may lead to the failure of the entire fracture or wellbore wall due to complex fracture or fracture network formation in the NWB.

Spacer fluids, such as spacer fluid 122 described above, may be specifically designed to enhance the operation, such as to improve the pressure pulse performance by suppressing viscous fingering of gas, or other product, produced by the energetic event. For example, the spacer fluid could include fibers, or other particles, at a suitable concentration in some cases, or the spacer could be a cross-linked gel with or without fibers entrained therein. Addition of fibers and or particles increases the viscosity and density of the spacer fluid, and also may result in the development of the yield-stress property of the spacer fluid. Higher viscosity combined with the yield stress suppress the development of fingers due to instability at the interface between the products of energetic event and the spacer fluid. Alternatively, the spacer fluid can be designed to have lower viscosity than the viscous pill in order to suppress development of viscous fingering on the interface between the spacer fluid and the viscous pill. The fingering instability at an interface is damped if the displacing fluid has viscosity higher than that of the displaced fluid. This way conditions for the Saffman-Taylor-like instability are not met and fingers due to instability will not develop.

Also, a portion of the viscous pill, or the product produced by the interaction of energetic event with the viscous pill, could serve as the spacer fluid as well. In some cases, the product produced by the energetic event, when also used as the spacer fluid, may be tailored to optimize plug-flow displacement instead of viscous fingering. The energetic event generates localized pulses of both heat and pressure, which can be altering rheological properties of the adjacent layers of the viscous pill. One example is the heat pulse increasing the tangling between polymeric fibers added to the viscous pill, thus increasing yield stress in it. Another example is creation of foam emulsions at the contact between energetic event and the viscous pill, where foam emulsions have increased viscosity.

In the course of some method embodiments of the disclosure, other wellbore fluids may be placed up hole from the location of the energetic event to also enhance the operation. Such wellbore fluids may be a composition similar to or same as the viscous pill, fluid with different viscosity or density or a fluid with engineered non-linear rheology. The wellbore fluids may comprise particles, such as fibers, proppant or collapsible glass spheres which may serve to efficiently suppress or otherwise dampen up hole energy produced from the energetic event.

As described above, some method embodiments may be single stage operations using coiled tubing conveyance and activation. This could be conducted at the beginning of a larger hydraulic fracturing treatment operation. For example, a coiled tubing apparatus may be used to circulate residual fluid present in the wellbore from earlier activity, and then place the viscous pill, energetic event forming fluids, and any other fluids in the wellbore to conduct the operation. The coiled tubing apparatus may also activate sliding sleeve(s) to enable contact of the viscous pill with the formation. The bottom hole assembly of the coiled tubing may then be backed off, and surface pumps are used to adjust the pressure in the annulus formed between the coiled tubing string and wellbore wall to an appropriate pressure less than the formation fracture initiation pressure. Then the energetic event is initiated proximate the treatment zone (such as 104*a* depicted in FIGS. 1 and 2*a*-2*c*) to locally increase the pressure on the viscous pill to a pressure equal to or greater than the formation fracture initiation pressure at the formation area of interest (such as NWB 106 and formation 102). In such embodiments, first control line or tubing 126 and/or second control line or tubing 130 may be incorporated into the coiled tubing string, or separate from the string. These embodiments may be useful in any type NWB and formation conditions, but may be particularly useful in those circumstances where severe NWB breakdown conditions exist, thus mitigating loss of well bore and/or fracture integrity due to undesired fracture network development in the NWB.

In another embodiment according to the disclosure, a multiple stage method using a fluid for both the wellbore fluid and viscous pill, where the fluid fill substantially all of the wellbore up hole from a packer set down hole from and proximate to the targeted treatment zone of the wellbore. With reference to FIGS. 1 and 2*a*-2*c*, a coiled tubing string is placed in wellbore 104, and a bottom hole assembly activates sliding sleeves to form openings 118. The coiled tubing bottom hole assembly circulates residual fluid present in the wellbore from earlier activity out of the wellbore, and places the fluid forming the viscous pill and wellbore fluid in wellbore 104. The coiled tubing string and bottom hole assembly are repositioned up hole from the targeted treatment zone 104*a*, and an energetic event generating material, or materials, is placed up hole and proximate the treatment zone 104*a*. The energetic event generating material, or materials, is then activated to release kinetic energy, such as by igniting or catalyzing the material(s) to generate the energetic event. Subsequently, as depicted in FIGS. 2*b* and 2*c*, the energetic event discharges energy 134 in the form of a pressure pulse, which is ultimately transmitted to viscous fluid pill 114, and pumps the viscous pill 114 through openings 118, at suitable pressure and flow rate to initiate a fracture in NWB 106 along plane 120, which further extends into formation 102. At this point one cycle is completed, and the portion of the cycle including placing and igniting or catalyzing the energetic event generating material, or materials, to ultimately fracture the formation may be repeated as many occurrences as specified, without placing a new viscous pill. Such an operation is considered a multi-staged or pulsed treatments operation according to the disclosure.

In another multi-staged or pulsed treatment operation, the wellbore fluid and viscous pill are different fluids, and in such methods, the viscous pill and the energetic event generating material, or materials, are replenished for each cyclical pulse. In some instances, this may be performed using two coiled tubing string assemblies, or by delivering alternating viscous pill and the energetic event generating material, or materials, through a single coiled tubing string assembly in series fashion.

In yet another pulsed treatment operation embodiment, methods according to the disclosure may be useful for jarring blockage in the NWB region when the fluid pressure in the wellbore begins to increase to a level indicating that treatment fluid is not effectively fracturing or otherwise entering the formation treatment zone. In such cases, a coiled tubing string may be used to deliver a pill of energetic event forming material(s) proximate the NWB region of concern, and thereafter generate pressure pulses as described above. The pressure pulses may force energy into openings (such as openings 118 depicted in the figures), and disrupt any blockage, such as bridged proppant, accumulating in the NWB, without overstressing the wellhead and associated surface equipment.

Figure 3A:
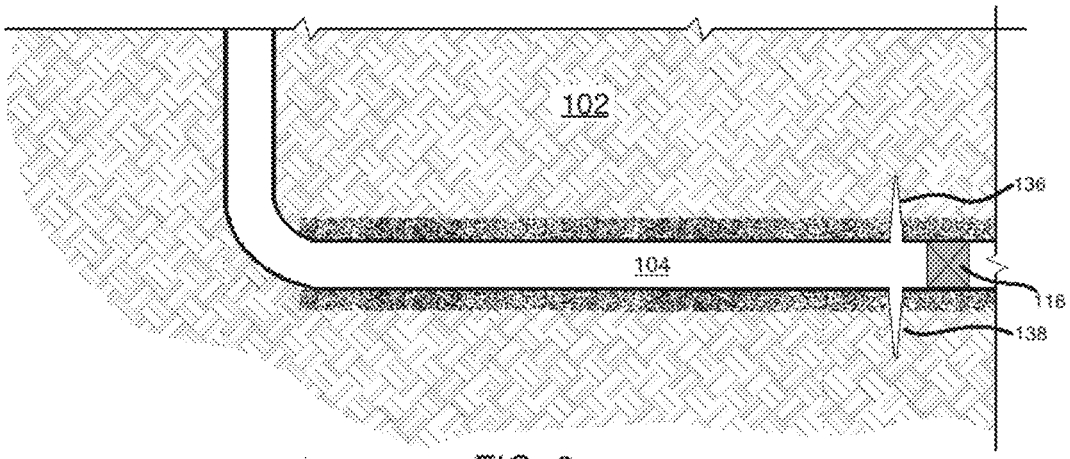
FIGS. 3*a*-3*c* illustrate some stages used forming substantially planar fracture(s) in a subterranean far field area, in accordance with some aspects of the disclosure, in a cross section view; and, FIGS. 4*a*-4*c* depict some stages used forming complex fracture(s) in a subterranean far field area, according to an aspect of the disclosure, in a cross section view.
Figure 3B:
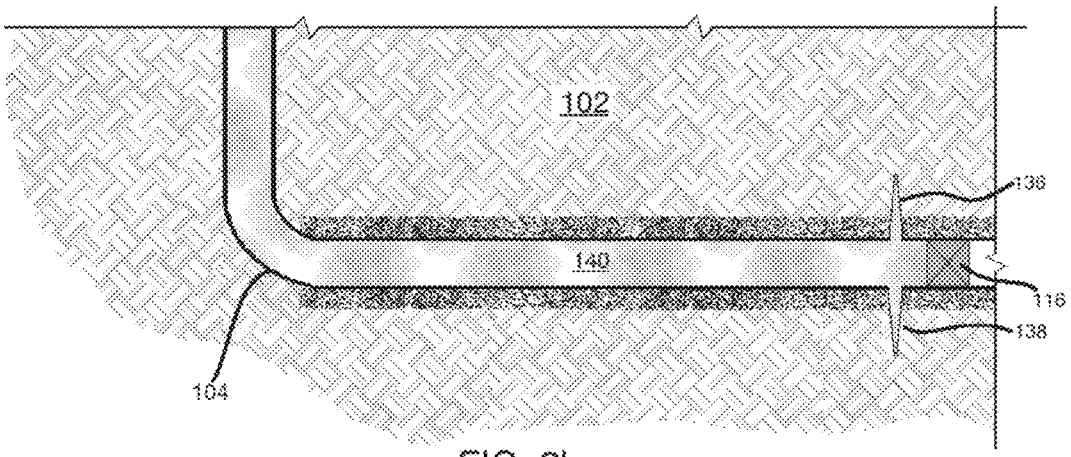
Figure 3C:
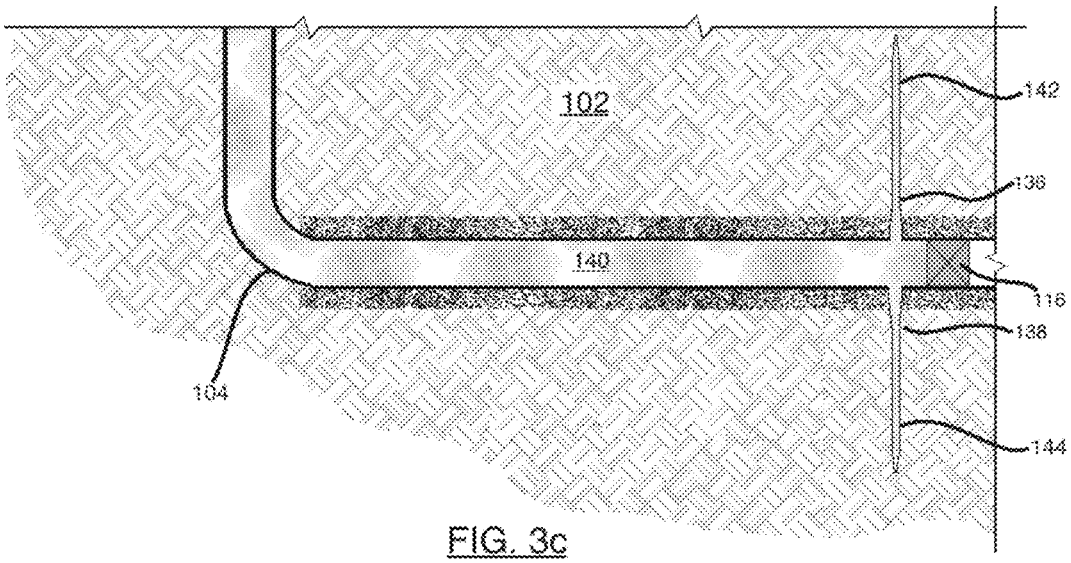

Once the initial fracture(s) through the NWB and into the formation is generated from the energetic event, the equipment and residual fluids used for this first operation may be removed from wellbore 104, as shown in FIG. 3*a*, although packer 116 may remain set in the wellbore down hole from fracture(s), and sufficient fluid pressure from the surface maintained in the wellbore to keep fractures 136 and 138 open. In a next operation, fluid (or fluids) 140 are introduced into wellbore 104 by surface equipment or coiled tubing string, in order to further extend fractures 136 and 138 into formation 102, as shown in FIG. 3*b*. The fluid, or fluids, may be a proppant laden viscous fluid, or a pad fluid followed by a proppant laden viscous fluid. The fluid(s) 140 are delivered to fractures 136 and 138 at a delivery rate and pressure sufficient to maintain the integrity of substantially planar fractures 136 and 138 through the NWB, while being of adequate delivery rate and pressure to further propagate the fractures further into the formation in a second stage. FIG. 3*c* illustrates fractures 136 and 138 as well as extended fractures 142 and 144 generated as a result of pumping fluid(s) 140 at an adequate delivery rate and pressure to further propagate fractures, while maintaining integrity of fractures 136 and 138 in the NWB.

Figure 4A:
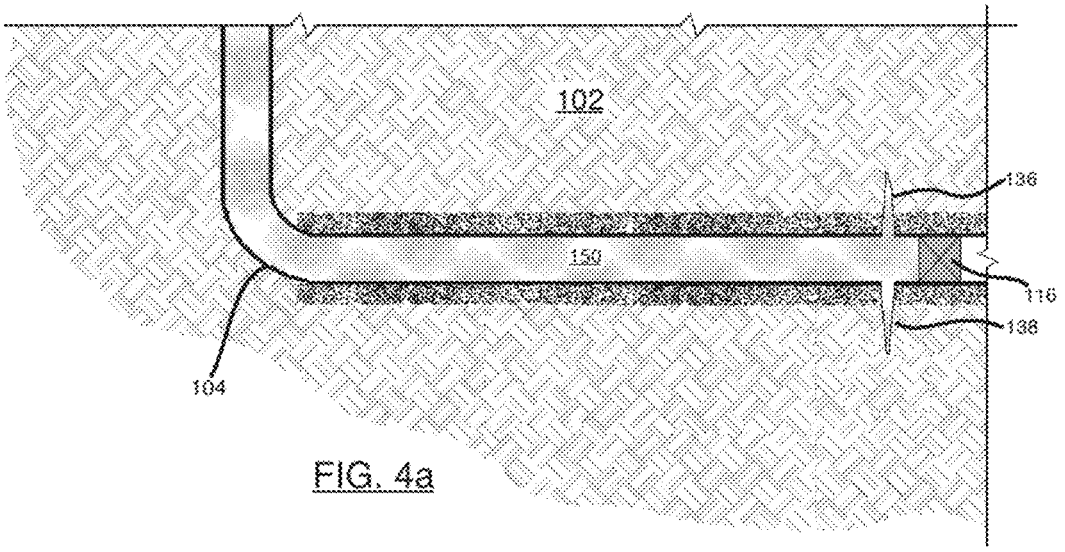
Figure 4B:
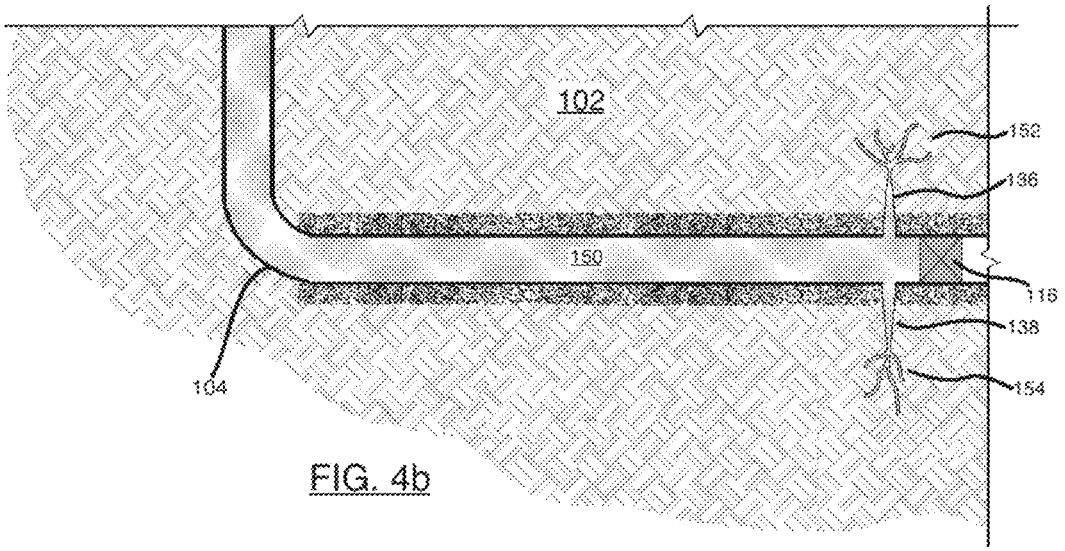
Figure 4C:
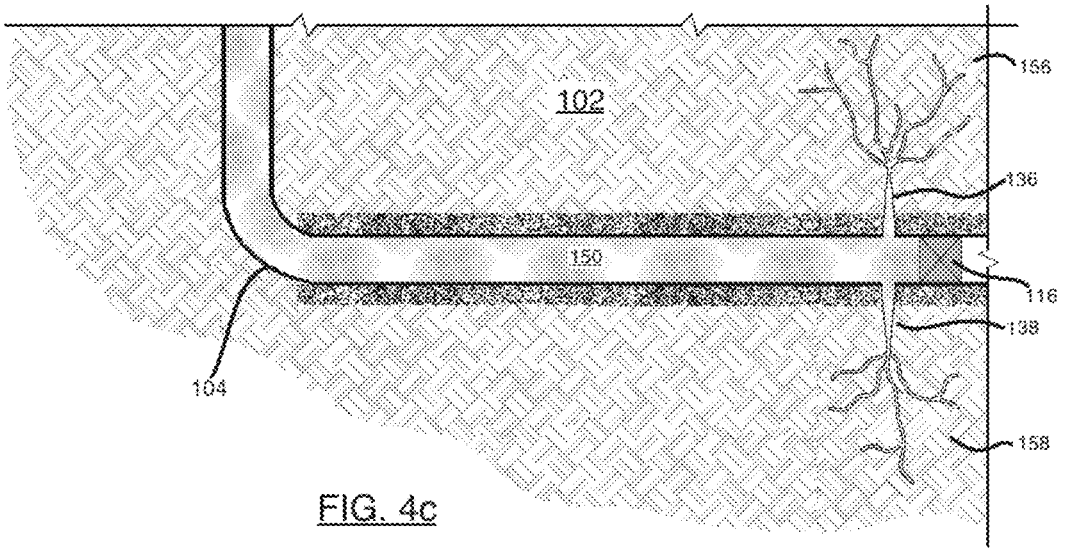

In yet other embodiments according to the disclosure, hybrid treatment operations are provided, where NWB fracture complexity is minimized, while the fracture complexity in the formation in the far-field region is achieved. In some formations, such as shale formations or other siliceous mudstone formations, complex fracture networks may increase the productive formation surface area, and thus, petroleum production. However, complexity present in the NWB region may hinder production, negatively affect fracture formation, and may lead to wellbore wall collapse or erosion. In these embodiments, initial fractures are formed through the NWB and near formation area, using techniques operational steps such as those described herein above and FIGS. 1 through 3*a*. These techniques may be useful to generate relatively simple NWB fractures with minimal rock-textural footprint. To illustrate one embodiment of such methodology, NWB region fractures 136 and 138 are created as described above, and wellbore substantially cleared of the operational fluids, as depicted in FIG. 3*a*. However, instead of placing a viscous fluid in the wellbore to extend substantially planar fractures, a low viscosity fluid 150 is pumped into the wellbore, such as shown in FIG. 4*a*, which may be slickwater, or slightly viscosified fluid. Pressure in wellbore 104 is such that the integrity of initial fractures 136 and 138 are maintained and remain open. Delivery rate and pressure of fluid 150 is set to initiate complex fractures 152 and 154 in the far field areas of formation 102, as depicted in FIG. 4*b*. Complex fractures 152 and 154 may be further extended by continuing to pump low viscosity fluid 150 to form fracture extensions 156 and 158, providing enhanced productive surface area while the NWB has improved stability where the fractures originate from the wellbore. These fractures are held open by pressure and proppant added to fluid 150 is placed in the fractures and maintain them open after the treatment operation is complete.

In yet other embodiments according to the disclosure the viscous pill pumped into the formation is also laden with proppant or proppant-like material, which, after entering into the formed fracture, can carry and sustain mechanical loads imposed by fracture walls under in-situ stresses at depth and by drag forces imposed by multiphase fluid flowing through the fracture. In some situations, the energetic fracturing can be conducted after there was pre-existing hydraulic fracture created at the same location earlier and, possibly, there was a history of production or injection of fluids from/to this location. Thus, re-fracturing and re-stimulating the formation and improving the near wellbore conductivity. Energetic re-fracturing can be more economical and have better environmental footprint than conventional re-fracking.

The disclosure is not only limited to methods of fracturing subterranean formations for the purpose of producing petroleum products, but may also be applied to generally fracturing a subterranean formations for other purposes including forming injection wells, mining, tunneling, geothermal applications and the like.

The foregoing description of the embodiments has been provided for purposes of illustration and description. Example embodiments are provided so that this disclosure will be sufficiently thorough, and will convey the scope to those who are skilled in the art. Numerous specific details are set forth such as examples of specific components, devices, and methods, to provide a thorough understanding of embodiments of the disclosure, but are not intended to be exhaustive or to limit the disclosure. It will be appreciated that it is within the scope of the disclosure that individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Also, in some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method, comprising:

placing a viscous fluid pill in a treatment zone of a wellbore completed by a single tubular body, wherein the viscous fluid pill comprises polymeric fibers and is in fluid communication with a near wellbore region of a subterranean formation through at least one opening in a casing disposed in the wellbore;

placing at least one energetic event generating material in the wellbore, wherein the at least one energetic event generating material comprises a fuel source and a reactive material, wherein the fuel source is delivered to the wellbore by a first control line or tubing inserted down hole within the single tubular body and the reactive material is delivered to the wellbore by a second control line or tubing inserted down hole within the single tubular body, wherein the at least one energetic event generating material is positioned up hole from the entirety of the viscous fluid pill; and generating at least one energetic event in the wellbore from the at least one energetic event generating material, thereby altering one or more rheological properties of a portion of the viscous fluid pill by increasing tangling between the polymeric fibers of the viscous fluid pill and forcing the viscous fluid pill into the near wellbore region through the at least one opening in the casing, and causing at least one hydraulic fracture to be formed in the near wellbore region from the at least one energetic event applying a pressure pulse onto the viscous fluid pill, wherein the portion of the viscous fluid pill improves a performance of the pressure pulse by suppressing development of viscous fingering produced by the at least one energetic event.

2. The method of claim 1, wherein the at least one hydraulic fracture formed in the near wellbore region is a substantially planar fracture.

3. The method of claim 2, wherein the substantially planar fracture extends into a near field region of the subterranean formation.

4. The method of claim 1, wherein the portion of the viscous fluid pill acts as a spacer fluid after the one or more rheological properties of the portion of the viscous fluid are altered between the viscous fluid pill and the energetic event generating material.

5. The method of claim 1, wherein a tamping fluid or a fluid package is placed in the wellbore up hole from the energetic event generating material.

6. The method of claim 1, wherein the viscous fluid pill and the at least one energetic event generating material are placed in the wellbore via a coiled tubing string inserted down hole within the single tubular body, and wherein the at least one energetic event is triggered by a mechanism integrated into the coiled tubing string.

7. The method of claim 1, wherein the at least one energetic event is generated up hole from the treatment zone.

8. The method of claim 1, wherein the fluid contains proppant to ensure that the hydraulic fracture remains open and conductive.

9. The method of claim 1, further comprising:

placing a second fluid in the wellbore after the at least one hydraulic fracture is formed in the near wellbore region; and increasing pressure of the second fluid to further extend the at least one hydraulic fracture into a far field area of the subterranean formation to form a substantially planar fracture.

10. The method of claim 1, comprising setting a packer in the wellbore downhole from the treatment zone prior to the placing the viscous fluid pill in the treatment zone.

11. The method of claim 1, comprising activating a sliding sleeve to enable contact of the viscous fluid pill with the near wellbore region of the subterranean formation through the at least one opening in the casing disposed in the wellbore.

12. The method of claim 1, wherein the portion of the viscous fluid pill comprises a cross-linked gel to increase the viscosity and the yield stress of the portion of the viscous fluid pill in order to suppress the development of the viscous fingering.

13. A method, comprising:

placing a viscous fluid pill in a treatment zone of a wellbore completed by a single tubular body, wherein the viscous fluid pill comprises polymeric fibers and is in fluid communication with a near wellbore region of a subterranean formation through at least one opening in a casing disposed in the wellbore;

generating at least one energetic event from at least one energetic event generating material positioned inside the wellbore up hole from the entirety of the viscous fluid pill, wherein the at least one energetic event generating material comprises a fuel source and a reactive material, wherein the fuel source is delivered to the wellbore by a first control line or tubing inserted down hole within the single tubular body and the reactive material is delivered to the wellbore by a second control line or tubing inserted down hole within the single tubular body; and forming at least one substantially planar fracture in the near wellbore region from the at least one energetic event by applying a pressure pulse onto the viscous fluid pill and forcing the viscous fluid pill into the near wellbore region through the at least one opening in the casing;

wherein the at least one energetic event alters one or more rheological properties of a portion of the viscous fluid pill by increasing tangling between the polymeric fibers of the viscous fluid pill, and wherein the portion of the viscous fluid pill improves a performance of the pressure pulse by suppressing development of viscous fingering produced by the at least one energetic event.

14. The method of claim 13, wherein the substantially planar fracture extends into a near field region of the subterranean formation.

15. The method of claim 14, further comprising:

placing a second fluid in the wellbore after the at least one substantially planar fracture is formed in the near wellbore region; and increasing pressure of the second fluid to further extend the at least one substantially planar fracture into a far field area of the subterranean formation to form a substantially planar fracture.

16. The method of claim 13, comprising setting a packer in the wellbore downhole from the treatment zone prior to the placing the viscous fluid pill in the treatment zone.

17. The method of claim 13, comprising activating a sliding sleeve to enable contact of the viscous fluid pill with the near wellbore region of the subterranean formation through the at least one opening in the casing disposed in the wellbore.

18. The method of claim 13, wherein the portion of the viscous fluid pill comprises a cross-linked gel comprising the polymeric fibers.

* * * * *